US010192668B2

(12) United States Patent
Igarashi

(10) Patent No.: US 10,192,668 B2
(45) Date of Patent: Jan. 29, 2019

(54) COIL COMPONENT

(71) Applicant: MURATA MANUFACTURING CO., LTD., Kyoto-fu (JP)

(72) Inventor: Akio Igarashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/408,537

(22) Filed: Jan. 18, 2017

(65) Prior Publication Data

US 2017/0229227 A1 Aug. 10, 2017

(30) Foreign Application Priority Data

Feb. 9, 2016 (JP) ..... 2016-022351

(51) Int. Cl.

| | |
|---|---|
| ***H01F 27/29*** | (2006.01) |
| ***H01F 27/24*** | (2006.01) |
| ***H01F 27/28*** | (2006.01) |
| ***H01F 3/10*** | (2006.01) |
| ***H01F 17/04*** | (2006.01) |

(52) U.S. Cl.

CPC ..... *H01F 27/24* (2013.01); *H01F 3/10* (2013.01); *H01F 17/045* (2013.01); *H01F 27/2823* (2013.01); *H01F 27/29* (2013.01); *H01F 27/292* (2013.01)

(58) Field of Classification Search

CPC ..... H01F 5/00; H01F 27/00–27/36
USPC ..... 336/65, 83, 192, 200, 232–234
See application file for complete search history.

(56) References Cited

U.S. PATENT DOCUMENTS 6,242,996 B1 * 6/2001 Sato ..... H01F 17/045 336/174
2015/0084731 A1 * 3/2015 Takagi ..... H01F 19/08 336/212

FOREIGN PATENT DOCUMENTS

| | | | |
|---|---|---|---|
| CN | 203503416 | U | 3/2014 |
| CN | 204011008 | U | 12/2014 |
| JP | 2005-322675 | A | 11/2005 |
| JP | 2008-66570 | A | 3/2008 |
| JP | 2009-302321 | A | 12/2009 |
| JP | 4737268 | B2 | 7/2011 |
| JP | 2014-099588 | A | 5/2014 |
| JP | 2015-65272 | A | 4/2015 |

OTHER PUBLICATIONS

An Office Action; "Notification of Reasons for Refusal," Mailed by the Japanese Patent Office dated Jul. 17, 2018, which corresponds to Japanese Patent Application No. 2016-022351 and is related to U.S. Appl. No. 15/408,537; with English language translation.
Notification of the First Office Action issued by the State Intellectual Property Office of the People's Republic of China dated Mar. 5, 2018, which corresponds to Chinese Patent Application No. 201611255043.X and is related to U.S. Appl. No. 15/408,537.

* cited by examiner

*Primary Examiner* — Tuyen Nguyen
(74) *Attorney, Agent, or Firm* — Studebaker & Brackett PC

(57) ABSTRACT

In the coil component, for dimensions measured along a predetermined direction of a winding core portion, a dimension of each of top surfaces of first and second flange portions is equal to or larger than a dimension of the winding core portion.

8 Claims, 8 Drawing Sheets

FIG. 4A
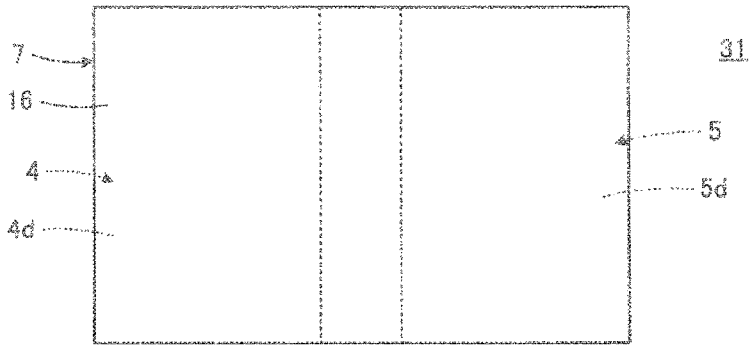
FIG. 4B
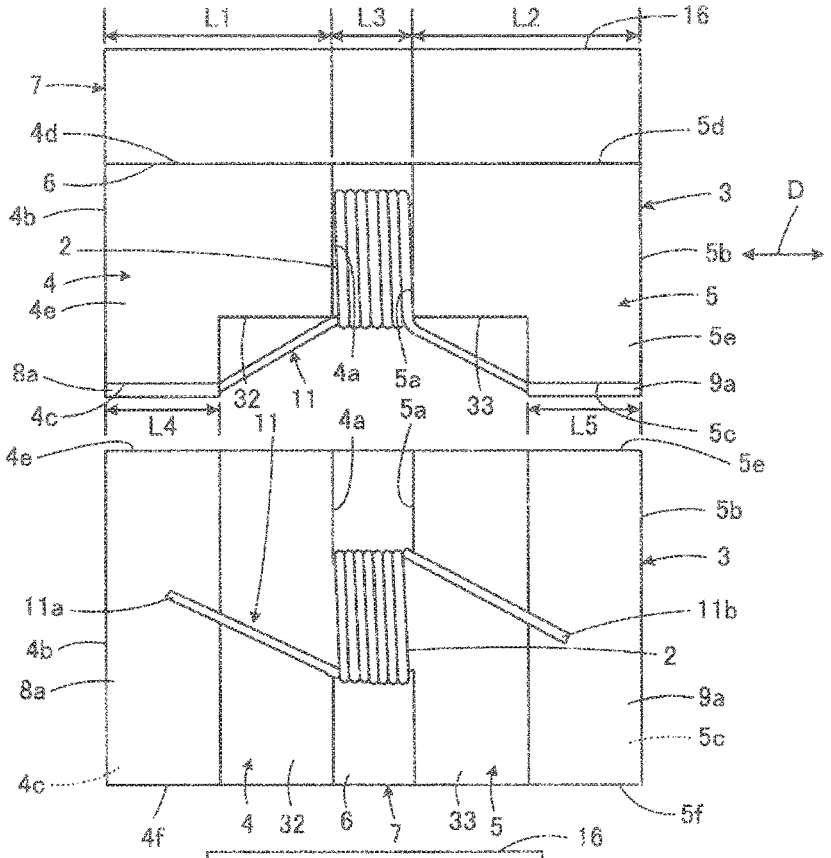
FIG. 4C
FIG. 4D
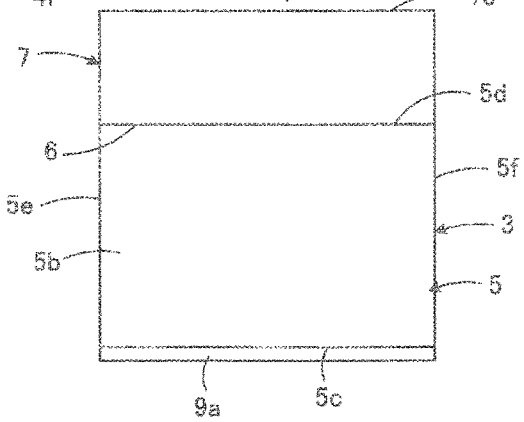

COIL COMPONENT

CROSS REFERENCE TO RELATED APPLICATIONS

This application claims benefit of priority to Japanese Patent Application 2016-022351 filed Feb. 9, 2016, the entire content of which is incorporated herein by reference.

TECHNICAL FIELD

The present disclosure relates to coil components, and more particularly relates to a coil component including a drum-shaped core having a winding core portion around which a wire is wound and flange portions provided at both end portions of the winding core portion.

BACKGROUND

For example, there is a configuration described in Japanese Patent No. 4737268 as a technology of interest for the disclosure. Japanese Patent No. 4737268 describes the following pulse transformer as a coil component.

The pulse transformer described in Japanese Patent No. 4737268 includes a drum-shaped core having a winding core portion and first and second flange portions provided at respective end portions of this winding core portion. Each of the first and second flange portions has an inner end surface that faces the side of the winding core portion and positions the corresponding end portion of the winding core portion, an outer end surface that faces the outer side opposite to the inner end surface, a bottom surface that couples the inner end surface with the outer end surface and faces the side of a mount substrate at mounting, and a top surface opposite to the bottom surface.

For example, four wires are wound around the winding core portion of the drum-shaped core. Three terminal electrodes are provided at each of the first and second flange portions. The terminal electrodes are positioned on the bottom surface of each flange portion. End portions of two wires are connected with two terminal electrodes among the three terminal electrodes on each flange portion. End portions of the residual two wires are commonly connected with the residual one terminal electrode.

Also, a plate-shaped core is bridged between the first and second flange portions. One principal surface of the plate-shaped core is in contact with the top surface of each of the first and second flange portions.

Such a pulse transformer is used for transmitting a communication signal and obtaining electrical insulation.

SUMMARY

Particularly focusing on the drawings of Japanese Patent No. 4737268, the drum-shaped core illustrated therein has the following dimensional relationship. That is, for dimensions measured along a winding center axis, the dimension of the top surface of one of the first and second flange portions (the thickness-direction dimension of the flange portion) is smaller than the dimension of the winding core portion (the length-direction dimension of the winding core portion). To be more specific, the dimension of the top surface of one of the flange portions is only about ¼ or smaller the dimension of the winding core portion. The winding center axis represents the center axis of the wound shape of the wires wound around the winding core portion. Also, in the drum-shaped core described in Japanese Patent No. 4737268, the first and second flange portions are provided at respective end portions of the winding core portion along the winding center axis.

In particular, a drum-shaped core of a coil component having an existing structure in which the winding center axis of a wire is parallel to a mount substrate, represented by the configuration described in Japanese Patent No. 4737268, typically has the above-described dimensional relationship for the following reasons.

First, a magnetic resistance generated by a gap unavoidably formed between the top surfaces of the flange portions and the one principal surface of the plate-shaped core is relatively large, and hence, magnetic efficiency in a closed magnetic path given by the drum-shaped core and the plate-shaped core becomes low. To compensate the aforementioned low magnetic efficiency and ensure a desirable inductance, it is required to increase the winding number of wire.

To increase the winding number of wire, the winding core portion has to be long. However, with the existing structure, the external dimension of the coil component is limited in view of mounting area. That is, the lengths of the flange portions are required to be decreased by the amount of the increase in the length of the winding core portion. Consequently, in a drum-shaped core having the existing structure described in many documents or being available in the market, the drum-shaped core has the aforementioned dimensional relationship, in which the flange portions are shorter than the winding core portion, and the dimensions of the flange portions are about ⅓ the dimension of the winding core portion at a maximum.

However, as the winding number of wire increases, an interline capacitance generated between turns of the wire increases, and a resistance loss also increases. The inventor of this application has focused on high frequency characteristics of the coil component with the above-mentioned existing structure being consequently degraded. For example, with the existing structure, it may be difficult to realize high frequency characteristics desirable in the future, such as one complying with the standard of 10GBASE-T.

Accordingly, it is an object of the disclosure to provide a coil component that decreases the influence of a magnetic resistance generated by a gap between flange portions and a plate-shaped core, and hence can acquire a larger inductance without increasing the winding number of wire.

According to one embodiment of the present disclosure, a coil component includes a drum-shaped core including a winding core portion and first and second flange portions provided at respective end portions of the winding core portion along a predetermined direction. Each of the first and second flange portions has an inner end surface that faces a side of the winding core portion and positions the corresponding end portion of the winding core portion, an outer end surface that faces an outer side opposite to the inner end surface, a bottom surface that couples the inner end surface with the outer end surface and faces a side of a mount substrate at mounting, and a top surface opposite to the bottom surface.

The coil component according to the embodiment of the disclosure further includes a plate-shaped core bridged between the first and second flange portions while one principal surface of the plate-shaped core contacts the top surface of each of the first and second flange portions; at least one first terminal electrode provided on the bottom surface of the first flange portion; at least one second terminal electrode provided on the bottom surface of the second flange portion; and at least one wire wound around the winding core portion and connected between the first and second terminal electrodes.

In this coil component, according to the embodiment of the disclosure for dimensions measured along the predetermined direction, a dimension of each of the top surfaces of the first and second flange portions is equal to or larger than a dimension of the winding core portion.

It should be understood that the configuration in which the dimension of each of the top surfaces of the first and second flange portions is equal to or larger than the dimension of the winding core portion as described above is relatively significant for clear differentiation from the related art.

With the above-described configuration, since the contact area between the first and second flange portions and the plate-shaped core can be largely ensured, a magnetic resistance which may be generated between the flange portions and the plate-shaped core can be decreased.

In another embodiment, the first and second flange portions may be joined with the plate-shaped core, for example, by an adhesive. In this case, the adhesive may be preferably arranged to surround contact surfaces of each of the top surfaces of the first and second flange portions and the principal surface of the plate-shaped core, except for portions along the inner end surfaces. With this configuration, the adhesive perimeter with the adhesive can be long. Even if the adhesive is applied merely to surround the contact surfaces, a sufficient adhesive force can be ensured.

In another embodiment of the disclosure, more preferably, the adhesive is not present on the contact surfaces of each of the top surfaces of the first and second contact portions of the first and second flange portions and the principal surface of the plate-shaped core. With this configuration, since the state in which the flange portions directly contact the plate-shaped core can be provided, for example, as compared with a situation in which the adhesive is interposed, the magnetic resistance which may be generated between the flange portions and the plate-shaped core can be further decreased, and hence this may contribute to acquisition of a larger inductance.

Also, according to another embodiment of the disclosure, preferably, the top surface of at least one of the first and second flange portions may have an outer periphery portion extending from the contact surface with respect to the plate-shaped core toward a side of an outer periphery of the plate-shaped core, and the adhesive may be arranged to contact the outer periphery portion and a side surface of the plate-shaped core. With this configuration, the adhesive can contact two surfaces directed in mutually different directions in a cross section. Accordingly, a higher adhesive force can be obtained.

According to another embodiment of the disclosure, at least one of the first and second terminal electrodes may be preferably arranged on the bottom surface of the first or second flange portion to extend from an end edge on a side of the outer end surface toward an end edge on a side of the inner end surface by a distance being half or smaller a distance between the outer end surface and the inner end surface. With this configuration, a relatively large space in which a terminal electrode is not present can be created near the winding core portion on the side of the bottom surface of the flange portions, that is, on the side of the mount surface. Also, the space in which a terminal electrode is not present near the winding core portion can be used as a buffer space that gives flexibility to the positions and orientations of the wires between an area on the winding core portion and an area on the terminal electrodes where the positions and orientations of the wires are fixed. Hence, the wires are not excessively forcedly deformed, and occurrence of a break or a short in the wires can be reduced.

According to another embodiment of the disclosure, a gradient surface or a step surface may be preferably formed on the side of the inner end surface on the bottom surface of at least one of the first and second flange portions. With this configuration, the space in which a terminal electrode is not present and which is formed on the side of the mount surface can be further widened, and a shorter path can be given to each of the wires guided to extend from the end portion peripheral surfaces of the winding core portion to the terminal electrodes.

According to another embodiment of the disclosure, a flat property of the top surface of at least one of the first and second flange portions may be preferably higher than a flat property of another principal surface opposite to the principal surface of the plate-shaped core. Instead of this configuration or in addition to this configuration, a flat property of the principal surface of the plate-shaped core which contacts each of the top surfaces of the first and second flange portions may be preferably higher than the flat property of the other principal surface of the plate-shaped core. With this configuration, the degree of close contact between the flange portions and the plate-shaped core can be increased, and a region where processing such as mirror-surface polishing is executed to increase the flat property can be minimized.

With the coil component according to another embodiment of the disclosure, the contact area between the first and second flange portions and the plate-shaped core can be largely ensured and hence the magnetic resistance which may be generated between the flange portions and the plate-shaped core can be decreased. Hence, a large inductance can be acquired without an increase in the winding number of wire. Accordingly, since the increase in capacitance or resistance loss due to the increase in the winding number of wire does not occur, a coil component with good high frequency characteristics can be provided.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIGS. 4A to 4D show a coil component according to a third embodiment of the disclosure, FIG. 4A being a plan view, FIG. 4B being a front view, FIG. 4C being a bottom view, FIG. 4D being a right side view.

DETAILED DESCRIPTION

Figure 1A:
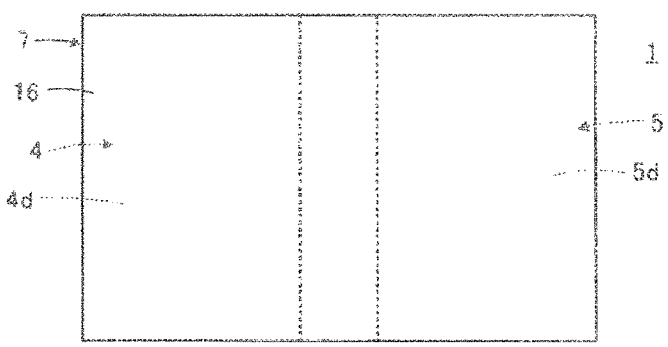
FIGS. 1A to 1D show a coil component according to a first embodiment of the disclosure, FIG. 1A being a plan view, FIG. 1B being a front view, FIG. 1C being a bottom view, FIG. 1D being a right side view.

A coil component 1 according to a first embodiment of the disclosure is described with reference to FIGS. 1A to 1D. The coil component 1 shown in FIGS. 1A to 1D configures a pulse transformer being an example of a coil component.

As shown in FIGS. 1A to 1D, the coil component 1 includes a drum-shaped core 3 to which a winding core portion 2 is provided. The drum-shaped core 3 also includes a first flange portion 4 and a second flange portion 5 provided at respective end portions of the winding core portion 2 along a predetermined direction D indicated by a double-headed arrow on the right side in FIG. 1B. The drum-shaped core 3 is configured of, for example, a magnetic substance such as ferrite.

The winding core portion 2 has, for example, a substantially circular cylindrical shape or a substantially polygonal cylindrical shape. Unevenness or an inclination may be formed on a surface of the winding core portion 2 if required.

The flange portions 4 and 5 have substantially rectangular parallelepiped shapes having substantially rectangular cross-sectional shapes. The flange portions 4 and 5 respectively have inner end surfaces 4*a* and 5*a* that face sides of the winding core portion 2 and position the respective end portions of the winding core portion 2, outer end surfaces 4*b* and 5*b* that face outer sides opposite to the inner end surfaces 4*a* and 5*a*, bottom surfaces 4*c* and 5*c* that face a side of a mount substrate (not shown) at mounting, top surfaces 4*d* and 5*d* opposite to the bottom surfaces 4*c* and 5*c*, first side surfaces 4*e* and 5*e*, and second side surfaces 4*f* and 5*f* opposite to the first side surfaces 4*e* and 5*e*. The bottom surfaces 4*c* and 5*c*, the top surfaces 4*d* and 5*d*, the first side surfaces 4*e* and 5*e*, and the second side surfaces 4*f* and 5*f* couple the inner end surfaces 4*a* and 5*a* with the outer end surfaces 4*b* and 5*b*, respectively.

The coil component 1 also includes a plate-shaped core 7 bridged between the first and second flange portions 4 and 5 while one principal surface 6 of the plate-shaped core 7 contacts each of the top surfaces 4*d* and 5*d* of the first and second flange portions 4 and 5. The plate-shaped core 7 has, for example, a principal surface with a substantially rectangular flat plate shape, and is configured of, for example, a magnetic substance such as ferrite similarly to the drum-shaped core 3. Accordingly, the plate-shaped core 7 configures a closed magnetic path in cooperation with the drum-shaped core 3.

Four first terminal electrodes 8*a*, 8*b*, 8*c*, and 8*d* are provided in that order on the bottom surface 4*c* of the first flange portion 4. Four second terminal electrodes 9*a*, 9*b*, 9*c*, and 9*d* are provided in that order on the bottom surface 5*c* of the second flange portion 5. In this embodiment, the four first terminal electrodes 8*a*, 8*b*, 8*c*, and 8*d* have dimensions equivalent to one another, and the four second terminal electrodes 9*a*, 9*b*, 9*c*, and 9*d* have dimensions equivalent to one another.

The terminal electrodes 8*a* to 8*d* and 9*a* to 9*d* are formed, for example, by applying a conductive paste containing conductive metal powder such as silver powder, then baking the paste, and further applying nickel plating and tin plating. Alternatively, the terminal electrodes 8*a* to 8*d* and 9*a* to 9*d* are formed, for example, by attaching conductive metal pieces formed of copper-based metal, such as tough pitch copper or phosphor bronze, on the flange portions 4 and 5.

The coil component 1 further includes four wires 11 to 14 wound around the winding core portion 2. The wires 11 to 14 are formed of, for example, copper lines covered for insulation with resin, such as polyurethane, polyesterimide, or polyamideimide, and each are connected between one of the first terminal electrodes 8*a* to 8*d* and one of the second terminal electrodes 9*a* to 9*d*.

The wires 11 to 14 are wound around the winding core portion 2 while a direction along the predetermined direction D serves as the winding center axis. Although not shown in detail, the wires 11 to 14 are wound to form two layers on the winding core portion 2. The two layers include an inner layer on the side that contacts the winding core portion 2 and an outer layer on the outer side of the inner layer. To be more specific, the first wire 11 and the third wire 13 are positioned on the side of the inner layer while being wound by bifilar winding, and the second wire 12 and the fourth wire 14 are positioned on the side of the outer layer while being wound by bifilar winding.

Also, the winding direction of the first wire 11 and the third wire 13 located on the side of the inner layer is opposite to the winding direction of the second wire 12 and the fourth wire 14 located on the side of the outer layer.

One end 11*a* of the first wire 11 is connected with the first terminal electrode 8*a*. The other end 11*b* of the first wire 11 is connected with the second terminal electrode 9*b*.

One end 12*a* of the second wire 12 is connected with the first terminal electrode 8*b*. The other end 12*b* of the second wire 12 is connected with the second terminal electrode 9*a*.

One end 13*a* of the third wire 13 is connected with the first terminal electrode 8*c*. The other end 13*b* of the third wire 13 is connected with the second terminal electrode 9*d*.

One end 14*a* of the fourth wire 14 is connected with the first terminal electrode 8*d*. The other end 14*b* of the third wire 14 is connected with the second terminal electrode 9*c*.

To connect the above-described wires 11 to 14 with the terminal electrodes 8*a* to 8*d* and 9*a* to 9*d*, for example, thermal pressure bonding, ultrasonic welding, or laser welding may be applied.

The coil component 1 having the above-described configuration has the following features. For the dimensions measured along the predetermined direction D, that is, for the dimensions measured along the winding center axis of the wires 11 to 14, each of dimensions L1 and L2 of the top surfaces 4*d* and 5*d* of the first and second flange portions 4 and 5 is equal to or larger than a dimension L3 of the winding core portion 2. That is, conditions L1≥L3 and L2≥L3 are satisfied. In this embodiment, the dimensions L1 and L2 are equivalent to each other; however, the dimensions L1 and L2 may be different from each other.

If this feature configuration is employed, the contact area between the flange portions 4 and 5 and the plate-shaped core 7 can be largely ensured, and hence the magnetic resistance which may be generated between the flange portions 4 and 5 and the plate-shaped core 7 can be decreased.

To be specific, as described above, a gap caused by the unevenness of the top surfaces 4*d* and 5*d* and the principal surface 6 is generated between the top surfaces 4*d* and 5*d* of the flange portions 4 and 5 and the principal surface 6 of the plate-shaped core 7. The gap is configured of the air or resin having a relative magnetic permeability of about 1, and hence has a larger magnetic resistance than those of the drum-shaped core 3 and the plate-shaped core 7 made of the magnetic substance. In terms of the magnetic resistance of the entire closed magnetic path, the magnetic resistance of the gap is dominant.

If the contact area between the flange portions 4 and 5 and the plate-shaped core 7 is increased, the ratio of the gap is relatively decreased, and the magnetic resistance of the closed magnetic path is decreased inversely proportionally to the contact area. Accordingly, in the coil component 1, the influence of the gap having the large magnetic resistance is relatively decreased at any of the contact surfaces of the flange portions 4 and 5 and the plate-shaped core 7, and the magnetic resistance which may be generated between each of the flange portions 4 and 5 and the plate-shaped core 7 can be decreased.

Also, the magnetic resistance of the entire closed magnetic path can be decreased accordingly. As the result, a large inductance can be acquired. In other words, even if the same inductance as that of the existing structure is acquired, the winding number of the wires 11 to 14 can be decreased. The same inductance as that of the existing structure can be acquired, and the capacitance and resistance loss can be decreased by the decrease in the winding number of the wires 11 to 14. Accordingly, the coil component 1 can have good high frequency characteristics.

Further, even if the dimensions L1 and L2 are larger than those of the existing structure, the dimension L3 is decreased. Hence, when the high frequency characteristics are improved, it is not required to increase the external size as compared with the existing structure. That is, with the coil component 1, good high frequency characteristics can be realized in case of the equivalent external shape and equivalent inductance to those of the existing structure.

To allow the aforementioned advantageous effects to be markedly attained, both the dimension L1 and the dimension L2 are preferably larger. Accordingly, more preferably, conditions L1≥L3×2 and L2≥L3×2 are satisfied.

The coil component 1 also has the following feature. The first terminal electrodes 8*a* to 8*d* are arranged on the bottom surface 4*c* of the first flange portion 4, to extend from an end edge on the side of the outer end surface 4*b* toward an end edge on the side of the inner end surface 4*a*, by a distance L4 which is half or smaller than the distance between the outer end surface 4*b* and the inner end surface 4*a* (the distance being equivalent to the dimension L1 in this embodiment). Similarly, the second terminal electrodes 9*a* to 9*d* are arranged on the bottom surface 5*c* of the second flange portion 5, to extend from an end edge on the side of the outer end surface 5*b* toward an end edge on the side of the inner end surface 5*a*, by a distance L5 which is half or smaller than the distance between the outer end surface 5*b* and the inner end surface 5*a* (the distance being equivalent to the dimension L2 in this embodiment). That is, conditions L4≤L1×½ and L5≤L2×½ are satisfied.

If the conditions L4≤L1×½ and L5≤L2×½ are satisfied, together with the conditions L1≥L3 and L2≥L3, a relatively large space in which a terminal electrode is not present can be created near the winding core portion 2, on the side of the bottom surfaces 4*c* and 5*c* of the flange portions 4 and 5, that is, on the side of the mount surface. The space in which a terminal electrode is not present near the winding core portion 2 can be used as a buffer space that gives flexibility to the positions and orientations of the wires 11 to 14 between an area on the winding core portion 2 and areas on the terminal electrodes 8*a* to 8*d* and 9*a* to 9*d* where the positions and orientations of the wires 11 to 14 are fixed. Hence, the wires 11 to 14 are not excessively forcedly deformed, and occurrence of a break or a short in the wires 11 to 14 can be reduced.

Also, if the terminal electrodes 8*a* to 8*d* and 9*a* to 9*d* are designed to satisfy the conditions L4≤L1×½ and L5≤L2×½, for example, terminal electrodes with the same dimensions as those of the terminal electrodes formed on the flange portions of the drum-shaped core having the dimensional relationship as described in Japanese Patent No. 4737268 can be arranged at the same positions. Accordingly, when the coil component 1 according to this embodiment is applied, the design of the mount substrate is not required to be changed.

In the drawings, the terminal electrodes 8*a* to 8*d* and 9*a* to 9*d* are positioned only on the bottom surfaces 4*c* and 5*c* of the first and second flange portions 4 and 5; however, part of the terminal electrodes may be provided to extend to an area on the outer end surfaces 4*b* and 5*b*.

Also, in the illustrated coil component 1, the terminal electrodes 8*a* to 8*d* and 9*a* to 9*d* have the same dimensions; however, it is not limited thereto, and may have different dimensions. Further, in this case, as long as at least one of the terminal electrodes 8*a* to 8*d* and 9*a* to 9*d* satisfies the condition L4≤L1×½ or L5≤L2×½, occurrence of a break or a short in the wires 11 to 14 connected with the terminal electrodes can be reduced.

Figure 2A:
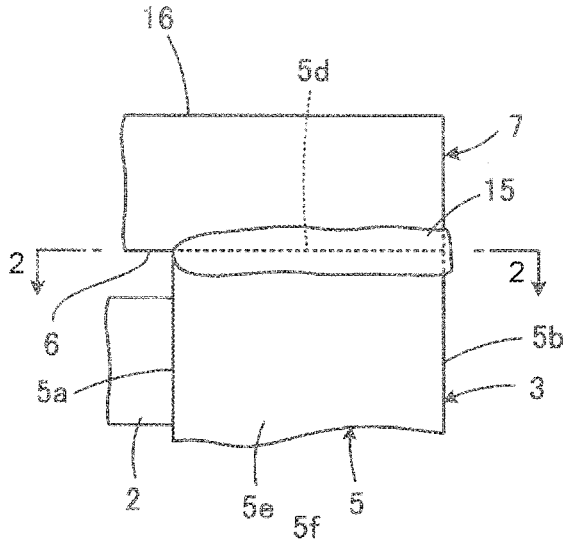
FIGS. 2A and 2B show a joint structure between a flange portion and a plate-shaped core of the coil component shown in FIGS. 1A to 1D, FIG. 2A being a front view, FIG. 2B being a cross-sectional view along line 2-2 in FIG. 2A.
Figure 2B:
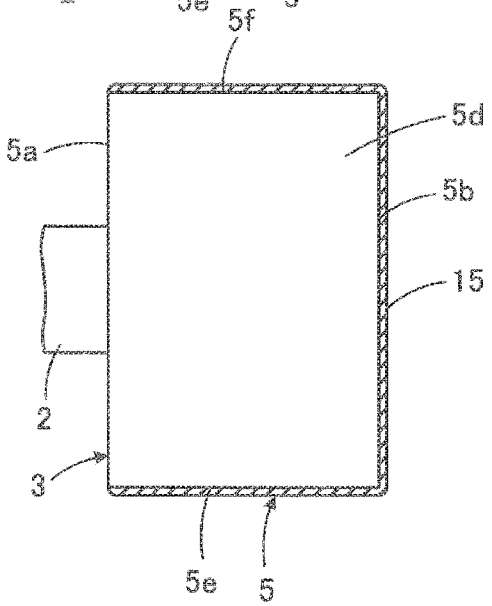
Figure 3A:
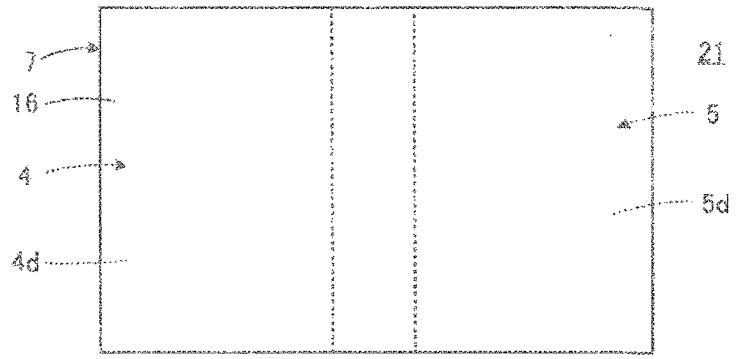
FIGS. 3A to 3D show a coil component according to a second embodiment of the disclosure, FIG. 3A being a plan view, FIG. 3B being a front view, FIG. 3C being a bottom view, FIG. 3D being a right side view.
Figure 3B:
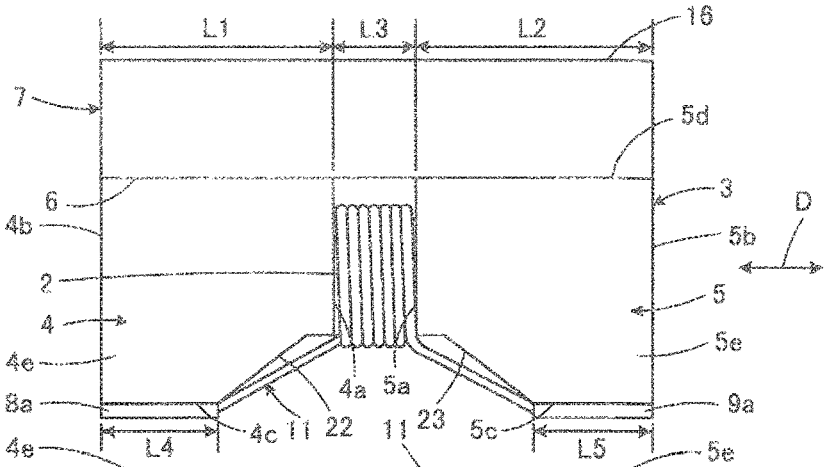
Figure 3C:
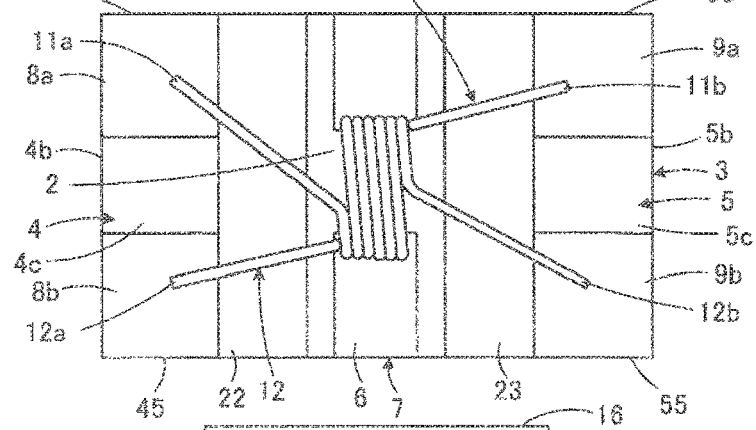
Figure 3D:
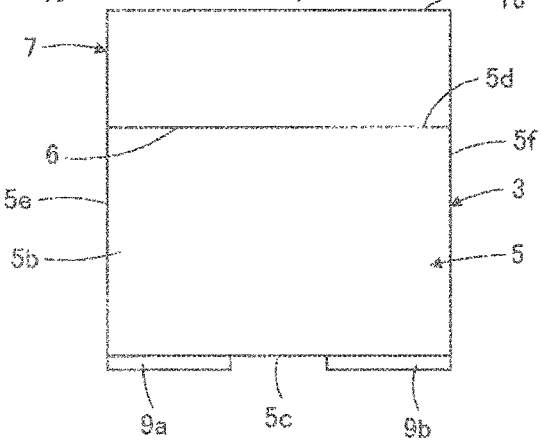

The first and second flange portions 4 and 5 are joined with the plate-shaped core 7, for example, by an adhesive. FIGS. 2A and 2B illustrate a joint structure between the second flange portion 5 and the plate-shaped core 7. The joint structure between the first flange portion 4 and the plate-shaped core 7 not illustrated in FIG. 2A or 2B is substantially similar to the joint structure between the second flange portion 5 and the plate-shaped core 7 illustrated in FIGS. 2A and 2B. Hence, in the following description, only the joint structure between the second flange portion 5 and the plate-shaped core 7 illustrated in FIGS. 2A and 2B is described.

An adhesive 15 is made of, for example, a resin material such as epoxy resin, and is arranged to surround the contact surfaces of the top surface 5*d* of the flange portion 5 and the principal surface 6 of the plate-shaped core 7 except a portion along the inner end surface 5*a*. As described above, in the coil component 1, the dimension L2 of the top surface 5*d* of the flange portion 5 is larger than that of the existing structure. With this configuration, the adhesive perimeter with the adhesive 15 can be long. Even if the adhesive 15 is arranged to merely surround the contact surfaces, a sufficient adhesive force can be ensured.

Also, as specifically illustrated in FIG. 2B, the adhesive 15 is not present on the contact surfaces of the top surface 5*d* of the flange portion 5 and the principal surface 6 of the plate-shaped core 7. With this configuration, the state in which the flange portions 4 and 5 directly contact the plate-shaped core 7 can be provided without the adhesive 15 having the larger magnetic resistance than those of the flange portions 4 and 5 and the plate-shaped core 7 interposed therebetween. The magnetic resistance which may be generated between the flange portions 4 and 5 and the plate-shaped core 7 can be decreased. Accordingly, this can contribute to acquisition of a larger inductance.

In FIGS. 1A to 1D, the adhesive 15 is not illustrated.

As described above, since the flange portions 4 and 5 directly contact the plate-shaped core 7, to further decrease the magnetic resistance which may be generated between the flange portions 4 and 5 and the plate-shaped core 7, it is effective to increase the flat properties of the contact surfaces of the flange portions 4 and 5 and the plate-shaped core 7, hence to increase the degree of close contact at the contact surfaces, and to decrease the gap formed between the flange portions 4 and 5 and the plate-shaped core 7. Owing to this, a configuration is employed in which the flat property of each of the top surfaces 4*d* and 5*d* of the flange portions 4 and and the principal surface 6 of the plate-shaped core 7 contacting the top surfaces 4*d* and 5*d* is higher than the flat property of the other principal surface 16 opposite to the principal surface 6 of the plate-shaped core 7. With this configuration, a region where processing such as mirror-surface polishing is executed to increase the flat property can be minimized.

For the flat property, the surface to be compared with the top surfaces 4*d* and 5*d* of the flange portions 4 and 5 and the principal surface 6 of the plate-shaped core 7 which contacts the top surfaces 4*d* and 5*d* is not limited to the other principal surface 16, and may be any one of surfaces of the flange portions 4 and 5 and the plate-shaped core 7 except the top surfaces 4*d* and 5*d* and the principal surface 6.

A surface having a higher flat property may be only one of the top surfaces 4*d* and 5*d* of the first and second flange portions 4 and 5.

In this specification, "flat property" is indicated by, for example, flatness defined in JIS B 0621, or arithmetical mean roughness (line roughness) Ra or arithmetical mean waviness Wa defined in JIS B 0601. In this case, the absolute value of such an index is not important, and the important point is the correlation between the flat properties of the top surfaces 4*d* and 5*d* and the principal surface 6 and the flat properties of the other surfaces of the drum-shaped core 3. It is only required to determine whether or not the configuration decreases the magnetic resistance due to the gap.

Next, a coil component 21 according to a second embodiment of the disclosure is described with reference to FIGS. 3A to 3D. The coil component 21 shown in FIGS. 3A to 3D configures a common mode choke coil being an example of a coil component. FIGS. 3A, 3B, 3C, and 3D respectively correspond to FIGS. 1A, 1B, 1C, and 1D. In FIGS. 3A to 3D, like reference signs are applied to elements corresponding to the elements shown in FIGS. 1A to 1D, and redundant description is omitted.

The coil component 21 shown in FIGS. 3A to 3D differs from the coil component 1 shown in FIGS. 1A to 1D for the number of wires. In particular, the coil component 21 includes two wires 11 and 12. Accordingly, two first terminal electrodes 8*a* and 8*b* are provided on the first flange portion 4, and two second terminal electrodes 9*a* and 9*b* are provided on the second flange portion 5. One end 11*a* of the first wire 11 is connected with the first terminal electrode 8*a*. The other end 11*b* of the first wire 11 is connected with the second terminal electrode 9*a*. One end 12*a* of the second wire 12 is connected with the first terminal electrode 8*b*. The other end 12*b* of the second wire 12 is connected with the second terminal electrode 9*b*.

Also, the winding direction of the first wire 11 is the same as the winding direction of the second wire 12. The first wire 11 and the second wire 12 may be wound by single-layer bifilar winding, or the first wire 11 and the second wire 12 may be wound in two layers so that one of the wires is arranged on the side of the inner layer and the other wire is arranged on the side of the outer layer.

Also, the coil component 21 shown in FIGS. 3A to 3D differs from the coil component 1 shown in FIGS. 1A to 1D for the forms of the flange portions 4 and 5 in the drum-shaped core 3. In particular, in the coil component 21, gradient surfaces 22 and 23 are formed at the bottom surfaces 4*c* and 5*c* of the flange portions 4 and 5 on the sides of the inner end surfaces 4*a* and 5*a*. The gradient surfaces 22 and 23 can further increase the space in which a terminal electrode is not present formed on the side of the bottom surfaces 4*c* and 5*c* of the flange portions 4 and 5, that is, on the side of the mount surface. In addition, a shorter or the shortest path can be given to each of the wires 11 and 12 guided from the end portion peripheral surfaces of the winding core portion 2 to the terminal electrodes 8*a*, 8*b*, 9*a*, and 9*b*.

Accordingly, the wires 11 and 12 can be guided from the end portion peripheral surfaces of the winding core portion 2 to the terminal electrodes 8*a*, 8*b*, 9*a*, and 9*b* in a more natural state, and hence occurrence of a break or a short in the wires 11 and 12 can be further reduced. Also, since the wires 11 and 12 can be shorter, the capacitance and direct-current resistance loss generated at the wires 11 and 12 can be decreased, and the high frequency characteristics of the coil component 1 can be further improved.

It is to be noted that a gradient surface may be provided at only one of the first and second flange portions 4 and 5.

Next, a coil component 31 according to a third embodiment of the disclosure is described with reference to FIGS. 4A to 4D. The coil component 31 shown in FIGS. 4A to 4D configures a normal inductor being an example of a coil component. FIGS. 4A, 4B, 4C, and 4D respectively correspond to FIGS. 1A, 1B, 1C, and 1D. In FIGS. 4A to 4D, like reference signs are applied to elements corresponding to the elements shown in FIGS. 1A to 1D, and redundant description is omitted.

The coil component 31 shown in FIGS. 4A to 4D differs from the coil component 1 shown in FIGS. 1A to 1D for the number of wires. In particular, the coil component 31 includes only a single wire 11. Accordingly, a single first terminal electrodes 8*a* is provided on the first flange portion 4, and a single second terminal electrode 9*a* is provided on the second flange portion 5. One end 11*a* of the first wire 11 is connected with the first terminal electrode 8*a*. The other end 11*b* of the first wire 11 is connected with the second terminal electrode 9*a*.

Also, the coil component 31 shown in FIGS. 4A to 4D differs from the coil component 1 shown in FIGS. 1A to 1D for the forms of the flange portions 4 and 5 in the drum-shaped core 3. In particular, in the coil component 31, step surfaces 32 and 33 are formed at the bottom surfaces 4*c* and 5*c* of the flange portions 4 and 5 on the sides of the inner end surfaces 4*a* and 5*a*. The step surfaces 32 and 33 attain advantageous effects similar to those of the gradient surfaces 22 and 23 in the coil component 21 shown in FIGS. 3A to 3D.

It is to be noted that a step surface may be provided at only one of the first and second flange portions 4 and 5.

In any of the coil components 1, 21, and 31 according to the above-described embodiments, the flange portions 4 and 5 and the plate-shaped core 7 have substantially rectangular parallelepiped shapes; however, it is not limited thereto, and, may have, for example, shapes with corners chamfered. Also, the shapes of the top surfaces of the flange portions and the principal surface of the plate-shaped core are not limited to substantially rectangular shapes, and may be substantially square shapes, substantially polygonal shapes, substantially circular shapes, substantially ellipsoidal shapes, or combinations of these.

FIGS. 5A to 7B show several characteristic values for comparison between a coil component within a range of the disclosure and a coil component outside the range of the disclosure to clarify the superiority of the coil component within the range of the disclosure.

To obtain the characteristic values shown in FIGS. 5A to 7B, pulse transformers were employed as a sample according to an example within the range of the disclosure and a sample according to a comparative example outside the range.

Figure 1B:
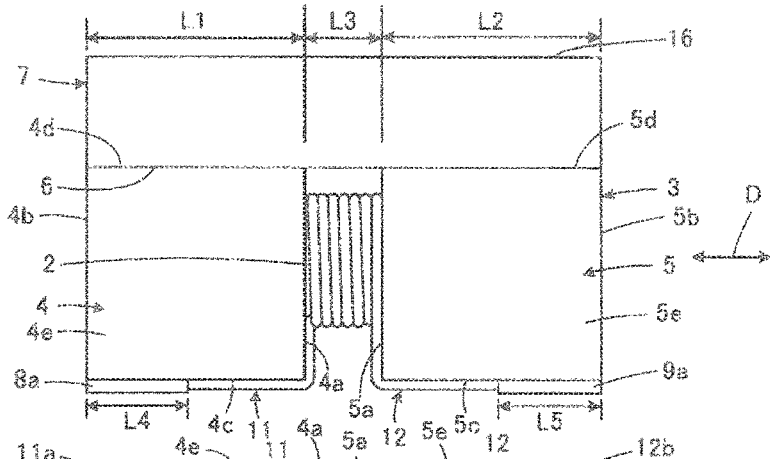
Figure 1C:
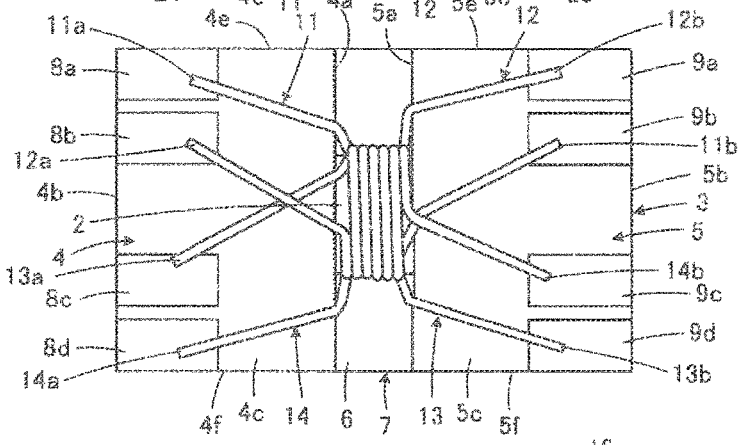
Figure 1D:
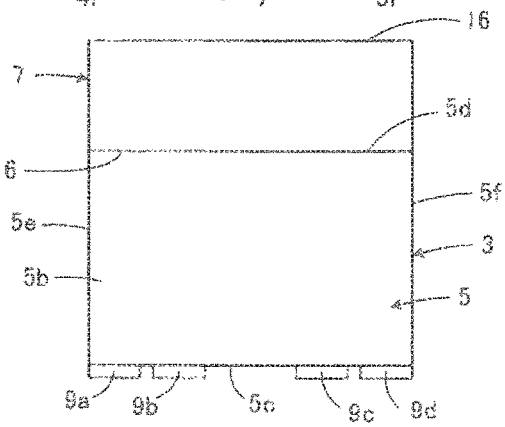

To be more specific, as the sample according to the example, there was prepared a sample having the structure shown in FIGS. 1A to 1D, external dimensions of 4.5 mm (length-direction dimension)×3.2 mm (width-direction dimension)×2.8 mm (thickness-direction dimension), and the dimensions L1, L2, and L3 shown in FIG. 1B being L1=L2=1.8 mm, and L3=0.9 mm.

In contrast, as the sample according to the comparative example, there was prepared a sample having the structure shown in FIG. 1 of Japanese Patent No. 4737268, external dimensions equivalent to those of the example, and the dimensions L1, L2, and L3 shown in FIG. 1B being L1=L2=1.0 mm and L3=2.5 mm.

Also, the pulse transformer according to the example and the pulse transformer according to the comparative example were set to have equivalent inductance values.

Figure 5A:
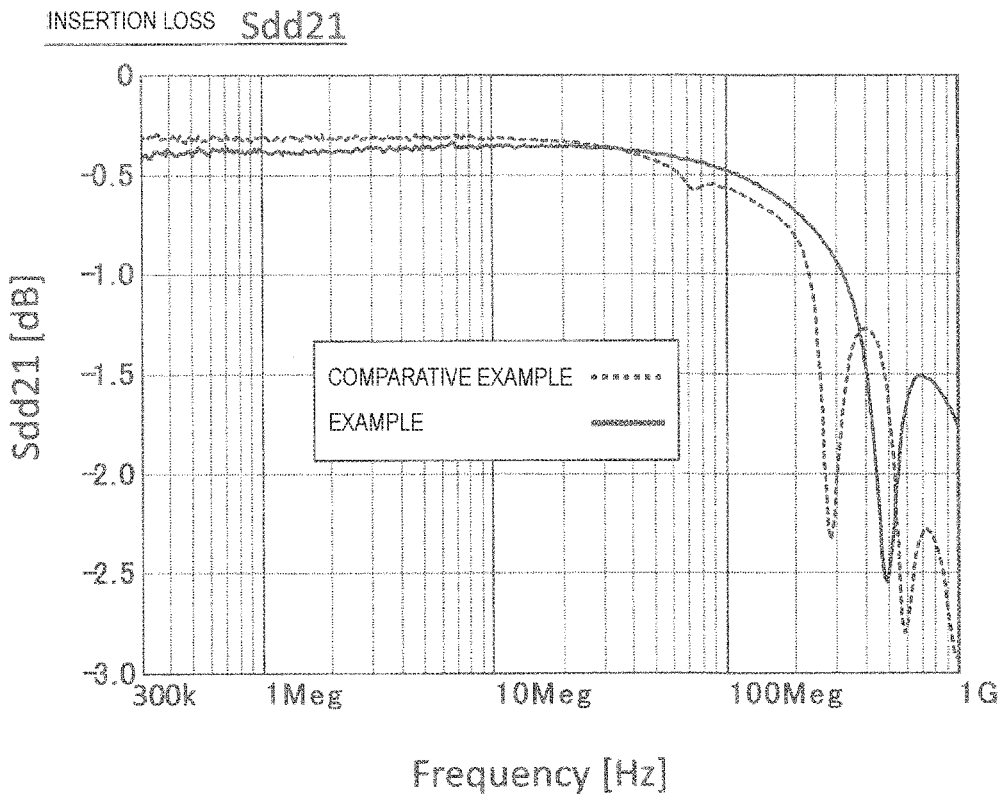
FIGS. 5A and 5B provide comparison between a pulse transformer according to an example within a range of the disclosure and a pulse transformer according to a comparative example outside the range, FIG. 5A showing frequency characteristics of an insertion loss, FIG. 5B showing a measurement circuit for the insertion loss.
Figure 5B:
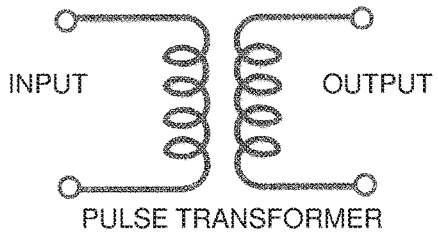

In FIGS. 5A and 5B, FIG. 5A shows frequency characteristics of an insertion loss Sdd21 obtained by a measurement circuit shown in FIG. 5B. The insertion loss Sdd21 shown in FIG. 5A represents a ratio of output to input expressed by unit of decibel [dB] obtained by using the measurement circuit shown in FIG. 5B. The example has higher Sdd21 (that is, smaller absolute value of minus dB) than the comparative example. That is, it is found that the example has better insertion loss characteristics than the comparative example. Also, it is found that the example has higher resonant frequencies than the comparative example, and hence the example can be used in a higher frequency region.

Figure 6A:
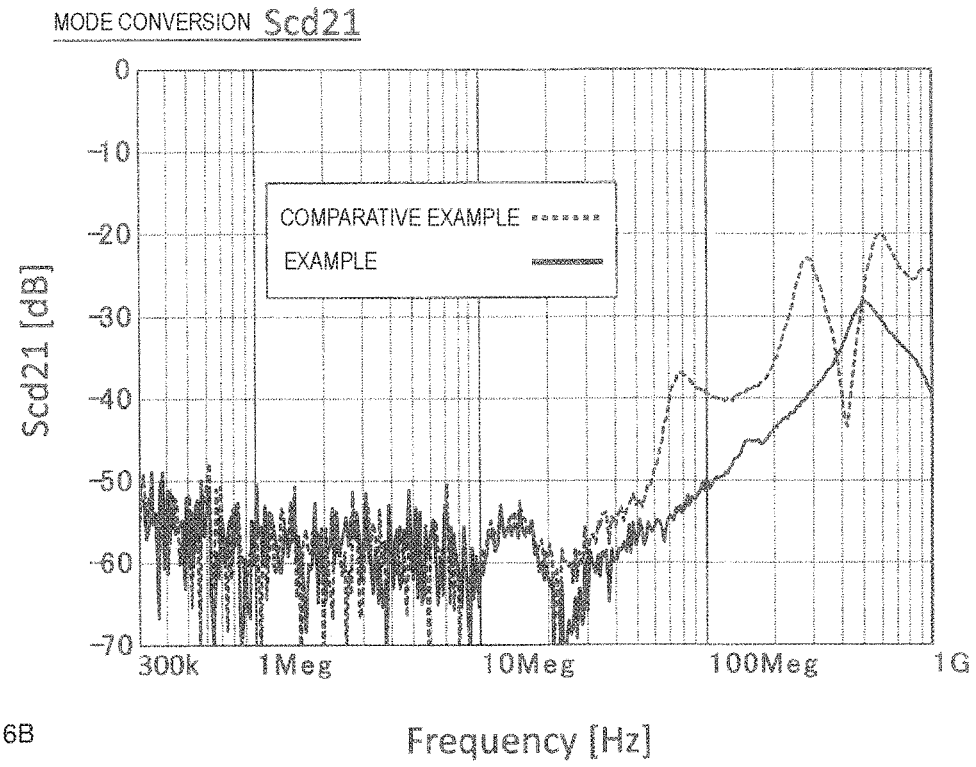
FIGS. 6A and 6B provide comparison between the pulse transformer according to the example within the range of the disclosure and the pulse transformer according to the comparative example outside the range, FIG. 6A showing frequency characteristics of a mode conversion, FIG. 6B showing a measurement circuit for the mode conversion.
Figure 6B:
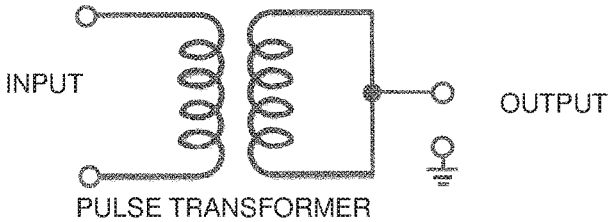

In FIGS. 6A and 6B, FIG. 6A shows frequency characteristics of a mode conversion Scd21 obtained by a measurement circuit shown in FIG. 6B. The mode conversion Scd21 shown in FIG. 6A represents a ratio of output to input expressed by unit of decibel [dB] obtained by using the measurement circuit shown in FIG. 6B. The example has lower Scd21 (that is, larger absolute value of minus dB) than the comparative example. That is, it is found that the example has better mode conversion characteristics than the comparative example. Also, it is found that the example has higher resonant frequencies than the comparative example, and hence the example can be used in a higher frequency region.

Figure 7A:
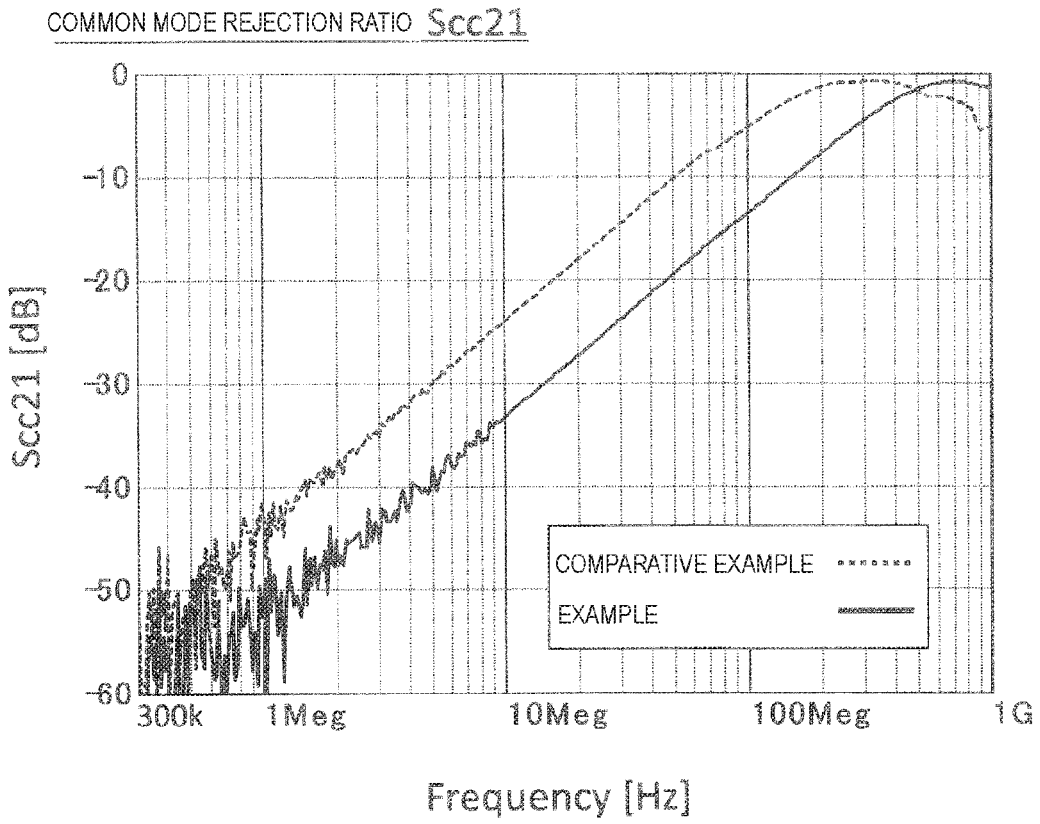
FIGS. 7A and 7B provide comparison between the pulse transformer according to the example within the range of the disclosure and the pulse transformer according to the comparative example outside the range, FIG. 7A showing frequency characteristics of a common mode rejection ratio, FIG. 7B showing a measurement circuit for the common mode rejection ratio.
Figure 7B:
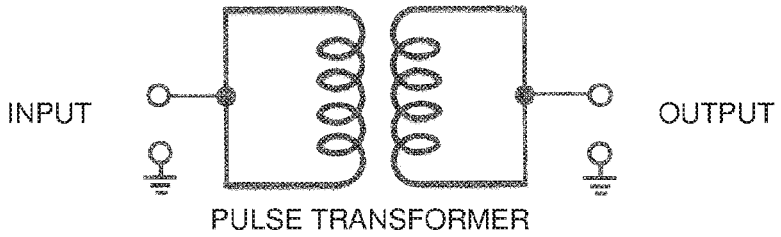

In FIGS. 7A and 7B, FIG. 7A shows frequency characteristics of a common mode rejection ratio Scc21 obtained by a measurement circuit shown in FIG. 7B. The common mode rejection ratio Scc21 shown in FIG. 7A represents a ratio of output to input expressed by unit of decibel [dB] obtained by using the measurement circuit shown in FIG. 7B. The example has lower Scc21 (that is, larger absolute value of minus dB) than the comparative example. That is, it is found that the example has better common mode rejection characteristics than the comparative example.

Regarding the above-described characteristic values shown in FIGS. 5A to 7B, the result indicative of the example is more preferable than the comparative example obtained because, in the example as compared with the comparative example, it is not required to increase the winding number of wire to acquire the equivalent inductance, hence the interline capacitance generated between turns of the wires can be small, and the insertion loss can be small.

In any of the coil components 1, 21, and 31 described with reference to FIGS. 1A to 4D, in the perspective view in the direction orthogonal to the direction in which the principal surface 6 of the plate-shaped core 7 extends, the outer peripheral edge of the plate-shaped core 7 is substantially aligned with the edges of the imaginary quadrangle defined by the two vertices on the side of the outer periphery of the top surface 4*d* of the first flange portion 4 and the two vertices on the side of the outer periphery of the top surface 5*d* of the second flange portion 5. In contrast, in fourth and fifth embodiments described below respectively with reference to FIGS. 8 and 9, the outer peripheral edge of the plate-shaped core 7 is located inside the edges of the imaginary quadrangle.

Figure 8:
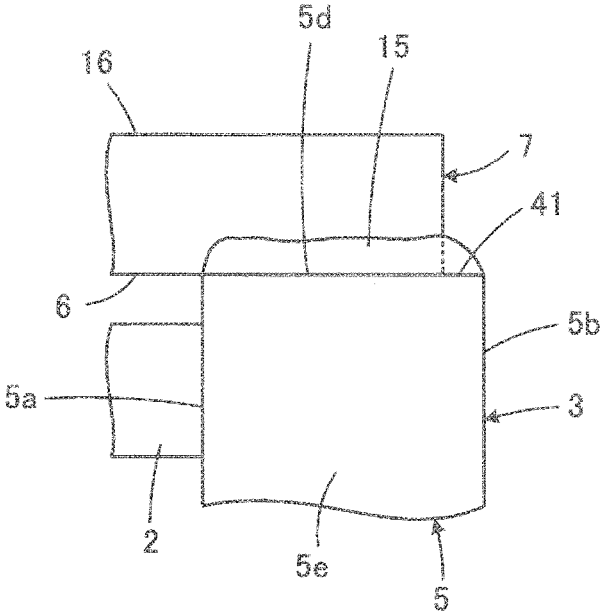
FIG. 8 is an illustration corresponding to FIG. 2A to explain a fourth embodiment of the disclosure.
Figure 9:
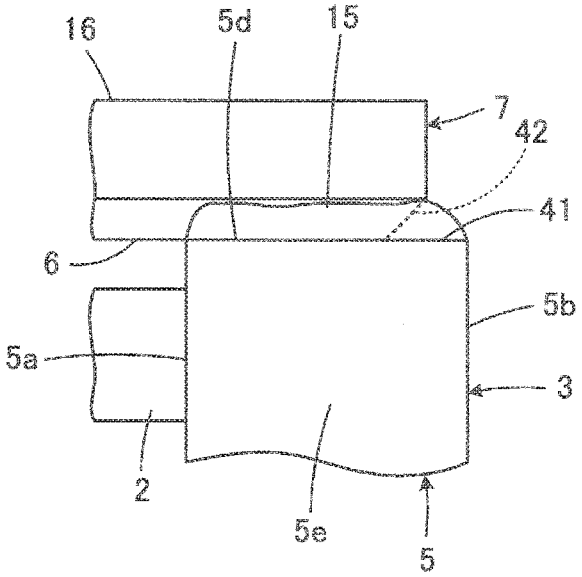
FIG. 9 is an illustration corresponding to FIG. 2A to explain a fifth embodiment of the disclosure.

FIGS. 8 and 9 are illustrations corresponding to FIG. 2A. In FIGS. 8 and 9, like reference signs are applied to elements corresponding to the elements shown in FIG. 2A, and redundant description is omitted.

In each of the embodiments shown in FIGS. 8 and 9, the top surface 5*d* of the flange portion 5 has an outer periphery portion 41 extending from the contact surface thereof with respect to the plate-shaped core 7 toward the side of the outer periphery of the plate-shaped core 7. The adhesive 15 is arranged to contact the outer periphery portion 41 and the side surface of the plate-shaped core 7, except for the portion along the inner end surface 5*a* of the flange portion 5.

With the above-described configuration, the adhesive perimeter with the adhesive 15 can be long, and the adhesive 15 forms a fillet. Hence, the adhesive 15 can contact two surfaces directed in mutually different directions in a cross section. Owing to this, with the configurations shown in FIGS. 8 and 9, a higher adhesive force can be obtained as compared with the configuration shown in FIG. 2A.

In particular, in the embodiment shown in FIG. 9, an outer peripheral edge of the plate-shaped core 7 on the side of the principal surface 6 is chamfered, and a gradient surface 42 is formed along the outer peripheral edge. Hence, the adhesive can be arranged to fill a recessed portion defined by the gradient surface 42 and the top surface 5*d* of the flange portion 5. As compared with the configuration shown in FIG. 8, a further high adhesive force can be obtained.

Although the description is omitted, the joint structure between the first flange portion 4 and the plate-shaped core 7 not illustrated in FIG. 8 or 9 is preferably substantially similar to the joint structure between the second flange portion 5 and the plate-shaped core 7 illustrated in FIGS. 8 and 9. However, it is not limited thereto. For the joint structure between the first flange portion 4 and the plate-shaped core 7, the joint structure shown in FIGS. 2A and 2B may be employed.

Also in the embodiments shown in FIGS. 8 and 9, although not shown, as shown in FIG. 2B, it is preferable that the adhesive 15 is not present on the contact surfaces of each of the top surface 4*d* of the first flange portion 4 and the top surface 5*d* of the second flange portion 5, and the principal surface 6 of the plate-shaped core 7.

As a modification of the embodiments shown in FIGS. 8 and 9, part of the adhesive 15 may be arranged to extend to areas on the outer end surfaces 4*b* and 5*b*, the first side surfaces 4*e* and 5*e*, and the second side surfaces 4*f* and 5*f* of the flange portions 4 and 5. Also, as a modification of the embodiment shown in FIG. 9, part of the adhesive 15 may be arranged to extend over the gradient surface 42 to areas on the side surfaces of the plate-shaped core 7.

The coil component according to the disclosure has been described above on the basis of the specific embodiments; however, the embodiments described above are merely examples, and partial replacement and combination are available for the configuration among the different embodiments. For example, the gradient surfaces 22 and 23 shown in FIG. 3B, or the step surfaces 32 and 33 shown in FIG. 4B may be employed in the coil component 1 shown in FIGS. 1A to 1D.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum-shaped core including a winding core portion and first and second flange portions provided at respective end portions of the winding core portion along a predetermined direction that is a length direction of the winding core portion;

each of the first and second flange portions having an inner end surface that faces a side of the winding core portion and positions the corresponding end portion of the winding core portion, an outer end surface that faces an outer side opposite to the inner end surface, a bottom surface that couples the inner end surface with the outer end surface and faces a side of a mount substrate at mounting, and a top surface opposite to the bottom surface;

a plate-shaped core bridged between the first and second flange portions while one principal surface of the plate-shaped core contacts the top surface of each of the first and second flange portions;

at least one first terminal electrode provided on the bottom surface of the first flange portion;

at least one second terminal electrode provided on the bottom surface of the second flange portion; and at least one wire wound around the winding core portion and connected between the first and second terminal electrodes, wherein, for dimensions measured along the predetermined direction, a dimension of each of the top surfaces of the first and second flange portions is equal to or larger than a dimension of the winding core portion.

2. The coil component according to claim 1, wherein the first and second flange portions are joined with the plate-shaped core by an adhesive, and the adhesive is arranged to surround contact surfaces of each of the top surfaces of the first and second flange portions and the principal surface of the plate-shaped core, except for portions along the inner end surfaces.

3. The coil component according to claim 2, wherein the adhesive is not present on the contact surfaces of each of the top surfaces of the first and second flange portions and the principal surface of the plate-shaped core.

4. The coil component according to claim 2, wherein the top surface of at least one of the first and second flange portions has an outer periphery portion extending from the contact surface with respect to the plate-shaped core toward a side of an outer periphery of the plate-shaped core, and the adhesive is arranged to contact the outer periphery portion and a side surface of the plate-shaped core.

5. The coil component according to claim 1, wherein at least one of the first and second terminal electrodes is arranged on the bottom surface of the first or second flange portion to extend from an end edge on a side of the outer end surface toward an end edge on a side of the inner end surface by a distance being half or smaller a distance between the outer end surface and the inner end surface.

6. The coil component according to claim 5, wherein a gradient surface or a step surface is formed on the side of the inner end surface on the bottom surface of at least one of the first and second flange portions.

7. The coil component according to claim 1, wherein a flatness of the top surface of at least one of the first and second flange portions is greater than a flatness of another principal surface opposite to the principal surface of the plate-shaped core.

8. The coil component according to claim 1, wherein a flatness of the principal surface of the plate-shaped core which contacts each of the top surfaces of the first and second flange portions is greater than a flatness of the other principal surface opposite to the principal surface of the plate-shaped core.

* * * * *